US005834698A

United States Patent [19]

Izui et al.

[11] Patent Number: 5,834,698

[45] Date of Patent: Nov. 10, 1998

[54] COMPOSITE CABLE WITH BUILT-IN SIGNAL AND POWER CABLES

[75] Inventors: Isao Izui, Chino; Tetsuo Imamura, Nagano-ken; Takaharu Shimamune, deceased, late of Sapporo-gun, by Masayuki Shimamune, Tsuru Shimamune, heirs; Yasomi Tojima, Gunma-ken; Keiji Takahashi, Kiryu, all of Japan

[73] Assignees: Mitsuba Corporation, Kiryu; Oki Electric Cable Co., Ltd., Kawasaki, both of Japan

[21] Appl. No.: 884,475

[22] Filed: Jun. 27, 1997

Related U.S. Application Data

[63] Continuation of Ser. No. 521,428, Aug. 30, 1995, abandoned.

[51] Int. Cl.[6] ..... H01B 11/02

[52] U.S. Cl. ..... 174/113 R; 174/117 F

[58] Field of Search ..... 174/113 R, 105 R, 174/36, 115, 113 A, 113 AS, 117 R, 117 F

[56] References Cited

U.S. PATENT DOCUMENTS

| | | | |
|---|---|---|---|
| 4,719,319 | 1/1988 | Tighe, Jr. | 174/117 F X |
| 4,992,625 | 2/1991 | Izui et al. | 174/36 |
| 5,053,583 | 10/1991 | Miller et al. | 174/36 |
| 5,149,915 | 9/1992 | Brunker et al. | 174/36 |
| 5,162,611 | 11/1992 | Nichols, III et al. | 174/36 |
| 5,329,065 | 7/1994 | Marney et al. | 174/113 R X |
| 5,428,187 | 6/1995 | Crane et al. | 174/36 |
| 5,463,186 | 10/1995 | Schricker | 174/36 |
| 5,491,299 | 2/1996 | Naylor et al. | 174/36 |

FOREIGN PATENT DOCUMENTS

| | | |
|---|---|---|
| 59-101321 | 7/1984 | Japan . |
| 60-62008 | 4/1985 | Japan . |
| 62-122012 | 6/1987 | Japan . |
| 63-45706 | 2/1988 | Japan . |
| 6-72119 | 10/1994 | Japan . |
| 56-81412 | 8/1995 | Japan . |

*Primary Examiner*—Kristine L. Kincaid
*Assistant Examiner*—Chau N. Nguyen
*Attorney, Agent, or Firm*—Oliff & Berridge PLC

[57] ABSTRACT

A composite cable with built-in signal an power cables is mainly used as a control cable for a machine tool and the like. The composite cable contributes to reduced cost, downsizing, higher reliability and higher safety, which are obtained because only a single cable needs to be laid, instead of the conventional cable, which requires multiple cables to be laid. In the composite cable with the built-in signal and power cables, a flat signal cable formed by a plurality of insulating cores arranged in parallel in the lengthwise direction, and having alternately repeated combined portions and separate portions is spirally wound into a roll around one or more power cables provided in the center of the composite cable. The power cables each have a large conductor size. A first shield is optionally provided around the flat signal cable. A second shield is optionally provided around the power cables. A sheath is provided around the flat signal cable or the first shield.

10 Claims, 5 Drawing Sheets

COMPOSITE CABLE WITH BUILT-IN SIGNAL AND POWER CABLES

This is a Continuation of application Ser. No. 08/521,428 filed Aug. 30, 1995, now abandoned.

BACKGROUND OF THE INVENTION

1. Field of the Invention

This invention relates to a composite cable with built-in signal and power cables. This composite cable is mainly used as a control cable for an NC machine tool. More particularly, this invention relates to a composite cable with built-in signal and power cables which contributes to reduced cost, downsizing, higher reliability and higher safety, which requires only a single cable to be laid, instead of a conventional cable, which requires laying multiple cables separately.

2. Description of the Related Art

In recent years, the number of production equipment such as an NC machine tool, transport equipment such as a conveyor, inspection equipment using a CCD camera or the like, and sequence computers for controlling the equipment has increased rapidly with automation and labor savings.

A well-known type of sheathed flat signal cable 11 is, as shown in FIG. 6, generally formed by providing a spacer or an elastic inclusion 12 for crush prevention in the center of the cable. A flat signal cable 13 is spirally wound around the spacer or elastic inclusion 12 into a roll. A sheath 14 is then provided around the rolled-up flat signal cable 13. Thus, the sheathed flat signal cable 11 is made separately from a power cable for driving the equipment. Such cables are laid in a bundle. Therefore, multiple cable laying is inevitable.

As the number of cables increases steadily, laying of the cables becomes disorderly. This causes an operator or an automated machine to trip over the cables, or leads to incorrect wiring. Solution of these problems has been hitherto desired.

SUMMARY OF THE INVENTION

This invention has been made as a result of vigorous studies to solve these problems. This invention thus provides a composite cable with built-in signal and power cables which contributes to reduced cost, downsizing, high reliability and high safety which are obtained because only a single cable needs to be laid, instead of the conventional cable, which requires multiple cables to be laid.

In order to achieve the above object, a composite cable is provided with built-in signal and power cables. The composite cable comprises one or more power cables provided in the center of the composite cable and having a large conductor size, a flat signal cable formed by a plurality of insulated cores arranged in parallel in the lengthwise direction of the flat signal cable and having alternately repeated combined portions and separated portions, which are spirally wound around the power cables into a roll, one or more optional shields, and a sheath provided around the flat signal cable or the shield.

These and other features and advantage of the invention are described in or apparent from the following detailed description of the preferred embodiments.

BRIEF DESCRIPTION OF THE DRAWINGS

The preferred embodiments of this invention will be described in detail, with reference to the following figures, wherein.

DETAILED DESCRIPTION OF THE PREFERRED EMBODIMENTS

Figure 1:
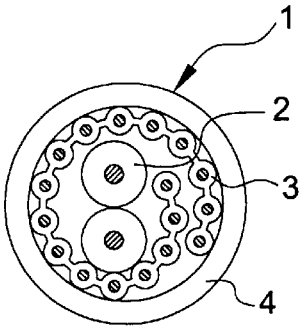
FIG. 1 is a cross-sectional view showing a two-phase power composite cable with built-in signal and power cables according to a first preferred embodiment of the present invention.
Figure 2:
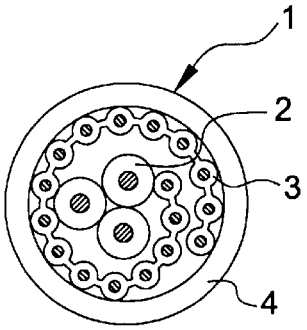
FIG. 2 is a cross-sectional view of a three-phase composite cable with built-in signal and power cables according to the first preferred embodiment of the present invention.

FIG. 1 is a cross-sectional view showing a two-phase power composite cable 1 with built-in signal and power cables according to a first preferred embodiment of the present invention. FIG. 2 shows a cross-sectional view of a three-phase power composite cable 1. As shown in FIGS. 1 and 2, the composite cables 1 with built-in signal and power cables are each formed by spirally winding a flat signal cable 3 into a roll around one or more power cables 2. Each of the power cables 2 has a large conductor size and a large current capacity and is located in the center of the composite cable 1. A sheath 4 is provided around the signal flat cable 3.

Figure 3:
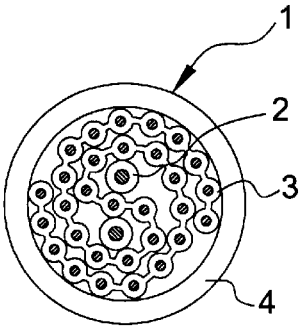
FIG. 3 is a cross-sectional view of the composite cable with built-in signal and power cables according to a second preferred embodiment of the present invention.

FIG. 3 is a cross-sectional view of the composite cable 1 with the built-in signal and power cables according to a second preferred embodiment of the present invention. In the second preferred embodiment of the composite cable 1, the flat signal cable 3 is shaped like a letter S (as shown) or inverse S (not shown) when it is wound around the power cables 2. The sheath 4 is then provided around the S-shaped flat signal cable.

Figure 7:
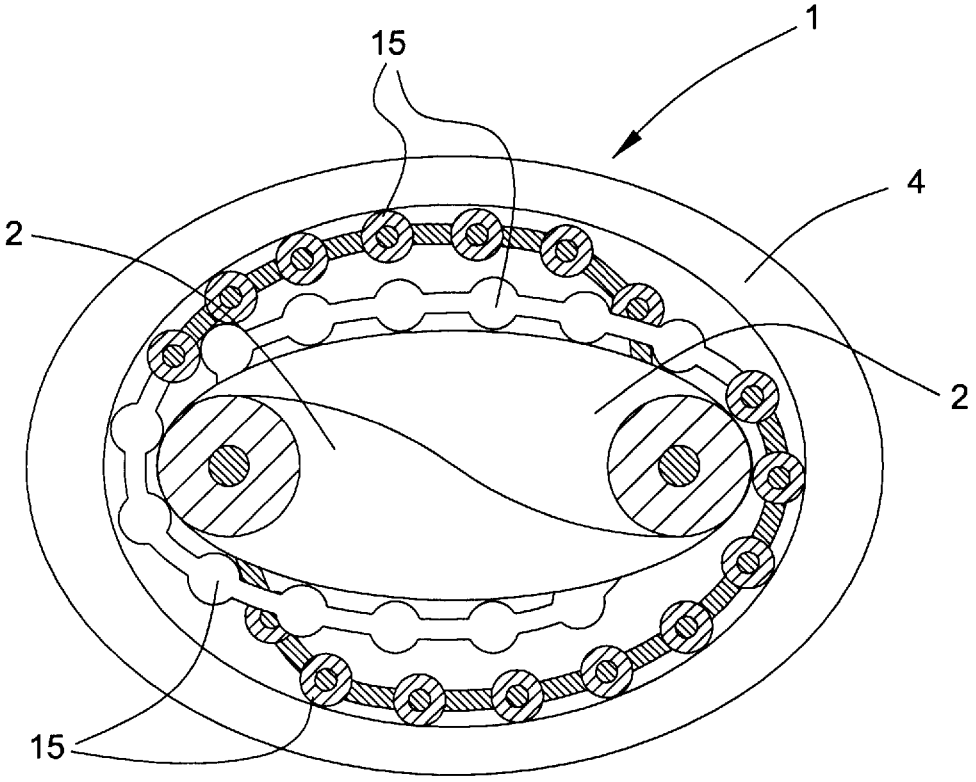
FIG. 7 is a cross-sectional view of a composite cable with built-in power cables and twisted pair flat cables.

FIG. 7 is a cross-sectional view of the composite cable 1 having a stwisted pair flat signal cable 15 would around a pair of power cables 2.

Figure 9:
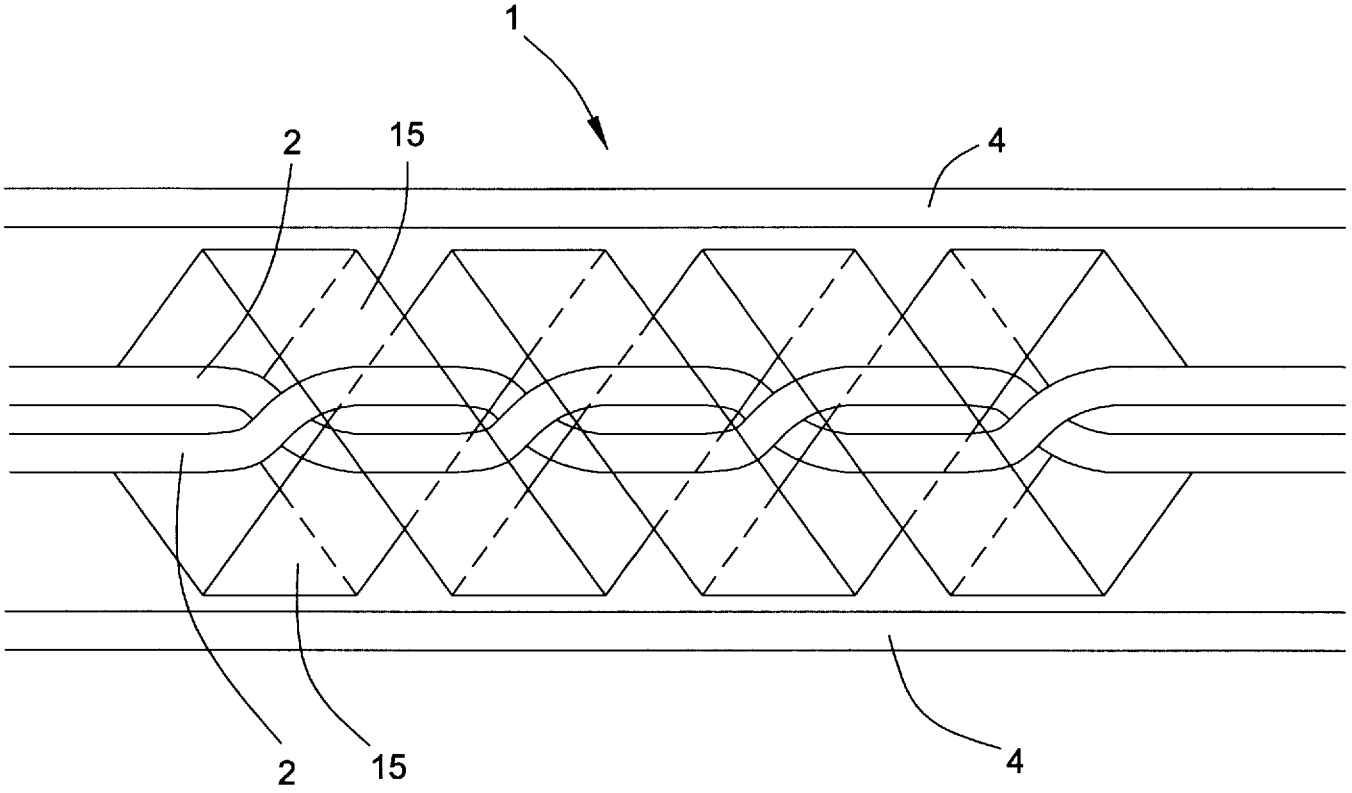
FIG. 9 is a perspective view of the composite cable shown in FIG. 7.

FIG. 9 is a perspective view of the composite cable shown in FIG. 7.

Figure 4:
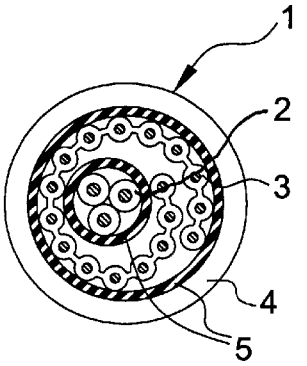
FIG. 4 is a cross-sectional view of the composite cable with built-in signal and power cables according to a third preferred embodiment of the present invention.
Figure 5:
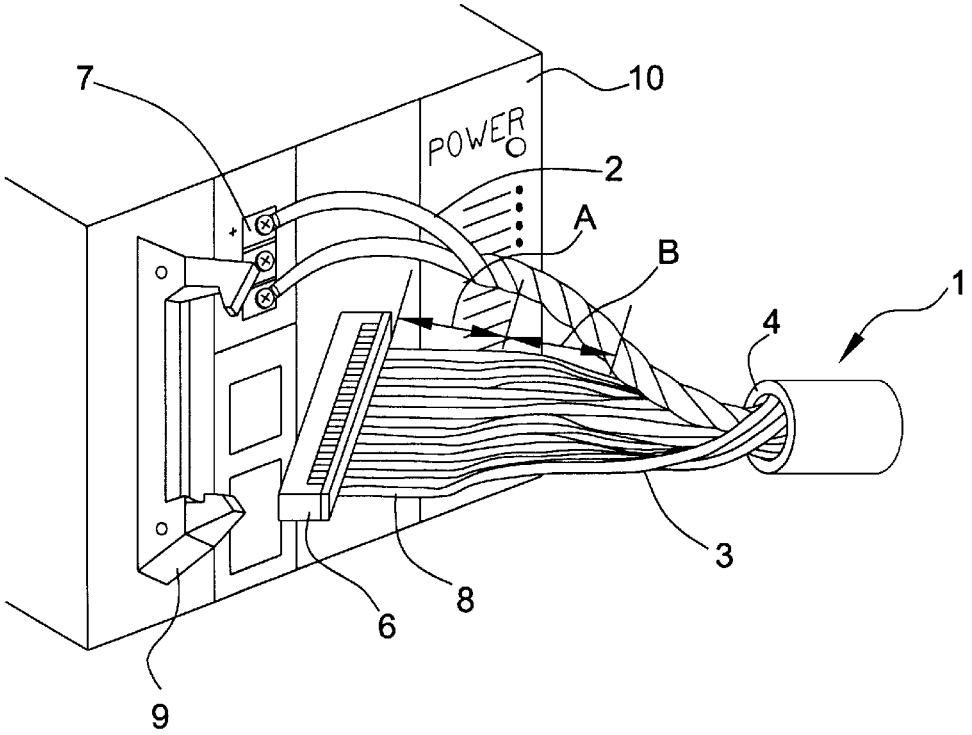
FIG. 5 is a perspective view showing an example of use of the composite cable with built-in signal and power cables according to the present invention.
Figure 6:
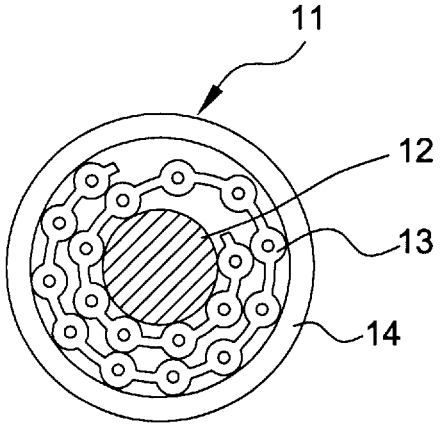
FIG. 6 is a cross-sectional view of a conventional sheathed flat cable.
Figure 8:
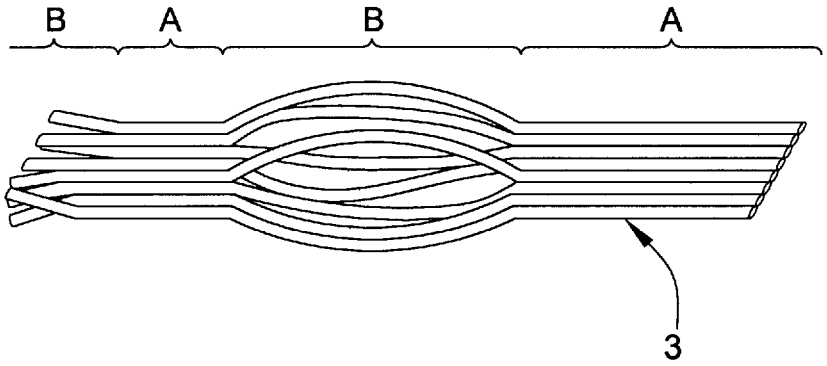
FIG. 8 is a perspective of flat cable having alternating connected in separate portions.

FIG. 4 is a cross-sectional view of the composite cable 1 with the built-in signal and power cables according to a third preferred embodiment of the present invention. In this third preferred embodiment, a first shield 5 is provided around the power cables 2 and a second shield 5 is provided around the flat signal cable 3. As shown in FIG. 5, the flat signal cable 3 is formed by a plurality of insulated cores or wires 8 which are arranged in parallel in the lengthwise direction. The elongated conductive wires 8 are covered with an insulating material which joins the plurality of conductive wires 8 into a flat ribbon, as shown in the combined portion A of FIG. 5. The flat signal cable 3 has alternately repeated combined portions A and separated portions B. In the separated portions B, the plurality of conductive wires 8 can be separated into a plurality of single wires, or a number of wire groups having one or more wires in each wire group. As shown in FIG. 5, the separated portions B have a number of wire groups with each wire group comprising three of the plurality of conductive wires 8. FIG. 8 shows a perspective view of the flat signal cable 3 more clearly showing how the combined portions A and separated portions B are alternately provided along the length of the flat signal cable 3. The composition of the flat signal cable 3 is not limited to the above outlined embodiments. Rather the flat signal cable 3 may be a twisted pair flat cable formed by one or more pairs of two twisted wires.

FIG. 5 shows an example of use of the composite cable 1 with the built-in signal and power cables according to the present invention. As shown in FIG. 5, a portion of the sheath 4 is removed from around the flat signal cable 3, which is taken apart by separating it from the power cables 2. The flat signal cable 3 is then attached to a general compression connector 6 and subjected to terminal treatment. The treated terminal is connected to a male connector 9 of another apparatus 10. At the same time, the power cables 2 are connected to a connection terminal block 7 of the other apparatus 10.

Although two separate and independent cables, a signal cable and a power cable, are needed conventionally, the composite cable 1 with the built-in signal and power cables of the present invention doubles both as a signal cable and as a power cable.

Furthermore, a conventional cable, in which a flat cable is wound in a spiral, is provided with an inclusion in the center of the conventional cable to prevent crushing of the cable. However, according to the composite cable 1 with the built-in signal and power cables of the present invention, since the center power cable also serves as the inclusion, no inclusion is needed and the cable is resistant to crushing.

Accordingly, disposal of the inclusion is unnecessary in terminal treatment and extra refuse is not produced, which contributes to conservation of resources.

As described above, according to the composite cable with the built-in signal and power cables of the present invention, it is possible to reduce the number of cables, to contribute to reduced cost, to simplify cable laying, and to downsize equipment.

Furthermore, tripping over the cable and incorrect wiring are reduced, laying of cables is visually simplified, and higher safety and higher reliability are obtained.

Although a typical flat cable is described above as an example, it is needless to say that various modifications in design, such as an internal or external shield structure or a transformed flat cable, may be made without departing from the scope of the present invention.

As described above, the composite cable with signal and power cables according to the present invention has great industrial significance because it contributes to the following points:

(a) reduced cost (b) downsizing (c) high reliability (d) high safety (e) conservation of resources.

While this invention has been described in conjunction with the specific embodiments outline above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A composite cable comprising:

at least two unconnected power cables provided in a center of said composite cable, said at least two unconnected power cables each having a large conductor size;

a flat signal cable unconnected to said at least two unconnected power cables and spirally wound around and directly contacting said at least two unconnected power cables into a roll; and a non-shielding sheath provided around and directly contacting said flat signal cable.

2. The composite cable of claim 1, wherein said flat signal cable is provided around said two power cables in an S-shaped spiral winding.

3. The composite cable of claim 1, wherein said at least two unconnected power cables comprises three unconnected power cables.

4. The composite cable of claim 1, wherein said flat signal cable comprises:

a plurality of elongated conductive wires; and insulating material formed around said plurality of elongated conductive wires;

wherein said insulating material has at least one connected portion wherein said insulating material around the plurality of elongated conductive wires is connected together, and at least one separated portion wherein said insulating material around each of said plurality of elongated conductive wires is separated into a plurality of separate portions.

5. The composite cable of claim 4, wherein said at least one connected portion comprises a plurality of connected portions, and said at least one separated portion comprises a plurality of separated portions, said plurality of connected portions alternating with said plurality of separated portions.

6. The composite cable of claim 4, wherein in each of said at least one separated portion the plurality of elongated wires are separated into a plurality of groups, each group comprising at least one of said plurality of elongated conductive wires and said surrounding insulating material.

7. The composite cable of claim 6, wherein each of said plurality of groups comprises three of said plurality of elongated conductive wires and said surrounding insulating material.

8. The composite cable of claim 1, wherein said flat signal cable comprises a twisted pair flat cable having at least one pair of twisted insulated elongated conductive wires.

9. A composite cable, comprising:

at least two unconnected power cables provided in a center of said composite cable, said at least two unconnected power cables each having a large conductor size;

a flat signal cable unconnected to said at least two unconnected power cables and spirally wound around and directly contacting said at least two unconnected power cables into a roll; and a sheath provided around said flat signal cable;

wherein the power cables are a central element around which the flat signal cable could be wound and wherein the at least two power cables are twisted together to form a twisted wire cable and are not connected to the flat signal cable.

10. A composite cable, comprising:

at least two unconnected power cables provided in a center of said composite cable, said at least two unconnected power cables each having a large conductor size;

a flat signal cable unconnected to said at least two unconnected power cables and spirally wound around and directly contacting said at least two unconnected power cables into a roll; and a sheath provided around said flat signal cable;

wherein the composite cable does not contain a central filler element around which the power cables and the flat signal cable could be wound and wherein the at least two power cables are twisted together to form a twisted wire cable and not connected to the flat signal cable.

* * * * *